US011857020B2

(12) United States Patent
Cohen et al.

(10) Patent No.: US 11,857,020 B2
(45) Date of Patent: Jan. 2, 2024

(54) COLLAPSIBLE PROTECTIVE HELMET

(71) Applicant: Coco Worldwide LTD, Borehamwood (GB)

(72) Inventors: Josh Sam Cohen, Herts (GB); Nicolas Dominic Cotton, London (GB); William Mark Wood, London (GB)

( * ) Notice: Subject to any disclaimer, the term of this patent is extended or adjusted under 35 U.S.C. 154(b) by 66 days.

(21) Appl. No.: 17/441,985

(22) PCT Filed: Mar. 25, 2020

(86) PCT No.: PCT/GB2020/000035

§ 371 (c)(1),
(2) Date: Sep. 22, 2021

(87) PCT Pub. No.: WO2020/201666

PCT Pub. Date: Oct. 8, 2020

(65) Prior Publication Data

US 2022/0218065 A1 Jul. 14, 2022

(30) Foreign Application Priority Data

Mar. 29, 2019 (GB) ..... 1904370
Dec. 23, 2019 (GB) ..... 1919206

(51) Int. Cl.
*A42B 3/32* (2006.01)
*A42B 3/06* (2006.01)

(52) U.S. Cl.
CPC ..... *A42B 3/322* (2013.01); *A42B 3/066* (2013.01)

(58) Field of Classification Search
CPC ..... A42B 3/322; A42B 3/066
See application file for complete search history.

(56) References Cited

U.S. PATENT DOCUMENTS 3,353,188 A * 11/1967 Crincic ..... A42B 3/322 2/171.1
4,587,676 A * 5/1986 Estadella ..... A42B 3/322 D29/107

(Continued)

FOREIGN PATENT DOCUMENTS

JP 2018062721 A 4/2018
JP 2018076614 A 5/2018

*Primary Examiner* — Khaled Annis
(74) *Attorney, Agent, or Firm* — Invention To Patent Services; Alex Hobson

(57) ABSTRACT

A collapsible protective helmet (10) comprises an impact-resistant base body (11) intended to encircle the head of a wearer and an impact-resistant crown (12) coupled to the base body by coupling means to be movable between a protective position in which the crown is supported by the base body in an orientation in which the crown covers the top of the head of the wearer and a stored position inverted relative to the protective position in which the crown is supported by, but nested in, the base body. The helmet further comprises releasable locking means for locking the base body (11) and crown (12) together in each of the two positions of the crown. The coupling means permits movement between those positions by pivotation of the crown relative to the base body in a direction away from the base body so as to no longer be supported by the base body rotation of the crown relative to the base body through substantially 180 degrees and pivotation of the crown relative to the base body in a direction towards the base body so as to again be supported by the base body.

19 Claims, 6 Drawing Sheets

(56) References Cited

U.S. PATENT DOCUMENTS

| | | | | |
|---|---|---|---|---|
| 2009/0222976 | A1* | 9/2009 | Loury | A42B 3/322 2/421 |
| 2015/0237947 | A1* | 8/2015 | Ferrando Garcia | A42B 3/322 2/410 |
| 2018/0279711 | A1 | 10/2018 | Szalkowski et al. | |
| 2019/0150549 | A1* | 5/2019 | Von Dunten | A42B 3/066 |
| 2022/0218065 | A1* | 7/2022 | Cohen | A42B 3/322 |

* cited by examiner

COLLAPSIBLE PROTECTIVE HELMET

The present invention relates to a protective helmet, including, but not limited to, a helmet for cyclists.

Protective helmets intended to provide impact protection for wearers are used in a wide range of fields and in some circumstances are mandatory. Such fields include construction sites, sport, equestrian activities and cycling, to mention but a few. A common requirement is a balance between impact resistance and weight, with the consequence that helmets are commonly formed from a single solid or apertured shell of suitable hard material with a lightweight cushioning lining. The helmet shell is invariably a bulky object and difficult or inconvenient to carry or store when not worn. This issue is particularly evident in the case of a cyclist or scooter-rider helmet, which may be worn for an outward journey of greater or lesser length and then may have to be carried or stored for an even greater period of time until worn again for a return journey.

In order to address the carriage and storage problem, various folding helmets have been designed and produced in the past. Helmets of this kind, which are collapsed as a unit rather than disassembled, are usually constructed from multiple elements—up to six in the case of some designs—which are able to slide, rotate or fold relative to one another in order to reduce the helmet to a smaller overall volume. One such folding concept involves construction from multiple curved elements which are united by pivot pins or simple plastics material hinges and which can be pivoted to lie against one another to form a somewhat flattened body and conversely pivoted away from one another to define an approximately hemispherical or hemi-ellipsoidal shape. Another folding concept is based on several annular elements and a cap element which are of graduated size and able to collapse into one another. This design is subject to the concern that the direction of collapse is coincident with impact direction. Yet another helmet in part emulates a pivoting visor, which in the collapsed state of the helmet still results in a relatively bulky object. These helmets are all characterised by a relatively large number of parts, varying levels of design and constructional complexity including several distinct steps to achieve folding or collapse and then restoration of the helmet shape, multiple potential fail points represented by numerous pivot or hinge connections in the unfolded state, and sometimes a comparatively small gain in volume reduction when collapsed. Further, the known folding helmets are largely constructed on the basis of use of polystyrene with a bonded polymer outer shell, thus two different materials.

It is therefore a principal object of the invention to create a protective helmet which has a low parts count and which can be collapsed from and restored to a wearable protective configuration by a simple procedure and without disassembly, so that the helmet remains a unit.

A further object is to provide a helmet of lightweight construction able to be produced entirely or predominantly from a single material.

Further objects and advantages will be apparent from the following description.

According to the present invention there is provided a collapsible protective helmet comprising an impact-resistant base body intended to encircle the head of a wearer, an impact-resistant crown coupled to the base body by coupling means to be movable relative thereto between a protective position in which the crown is supported by the base body in an orientation in which the crown covers the top of the head of the wearer when the helmet is worn and a stored position which is inverted relative to the protective position and in which the crown is supported by, but nested in, the base body when the helmet is not worn, and releasable locking means for locking the base body and the crown together in each of the two positions of the crown, the coupling means permitting movement between those positions by pivotation of the crown relative to the base body in a direction away from the base body so as to no longer be supported by the base body in the protective position, rotation of the crown relative to the base body through substantially 180 degrees and pivotation of the crown relative to the base body in a direction towards the base body so as to be supported by the base body in the stored position.

A helmet embodying the present invention has the substantial advantage that a wearable protective structure constituting the helmet can be composed of only two principal protective elements, namely the base body and crown, which in all configurations of the helmet remain united as an assembly and which can be constructed from the same material, including moulding in a single mould as separate components or as a single component separable into parts. Collapsing of the helmet to transfer the crown to its stored position and restoration of the helmet to return the crown to its protective position can be achieved by a simple sequence of pivotation, rotation through half a revolution and reverse pivotation, in conjunction with preliminary unlocking and subsequent relocking of the base body and crown by way of the locking means. Depending on the particular form of the base body and crown, a reduction in volume of the helmet in its collapsed state of more than 40 percent is possible. In this state, the helmet has a flattish discoid form compatible with, for example, stowage in a travel bag or pack. Such a helmet is notably less complicated in construction than typical prior art designs and has fewer parts, which contributes to economy in manufacture, yet remains capable of simple and quick transfer between a wearable protective configuration and a collapsed carriage and stowage configuration.

For preference, the coupling means comprises a universal joint, which economically combines capabilities of pivot and rotational motions in different planes or about mutually perpendicular axes in a single assembly, although separate joints for the two motions are feasible. Such a universal joint is preferably a ball-and-socket joint, thus a ball rotatably mounted in a socket, which allows a range of relative angular movement substantially equivalent to that of a Cardan form of joint with significantly fewer parts and less potential wear or fracture points. In a preferred construction employing a ball-and-socket joint the ball is provided at the crown and the socket at the base body, which may offer ease of manufacture by comparison with a converse arrangement. For preference, the socket is then formed in a pedestal of the base body and the crown has a recess receiving the pedestal when the crown is in the protective position. Such a configuration allows formation of a ball-and-socket joint of robust construction, particularly with regard to bracing of the load-bearing wall of the socket, without disruption of the aesthetics of the helmet; for example, a smoothly curved transition between base body and crown in the region of the joint can be achieved through the pedestal.

In a preferred embodiment the ball is formed integrally with the crown, which results in a particularly rigid connection of the ball with the crown in conjunction with an economic method of manufacture. Interconnection of the ball and socket is facilitated if, for example, the ball is made of yielding material and is slotted to allow resilient compression under an externally applied pressure causing the ball material to yield. The ball can then be a press fit in the socket. Additionally or alternatively, however, the socket can be of multi-part design and adjustable between an open configuration for ball reception and a closed configuration closely shrouding the ball and securely resisting any possibility of non-destructive separation. If so desired, the socket wall can be formed by or include reinforcing material of greater rigidity than the rest of the base body. The mentioned preferred features of socket and ball construction are equally applicable to a converse arrangement of the ball at the base body and the socket at the crown.

For preference, the helmet has an intended front and back orientation with respect to wearing by a wearer and the coupling means is provided at the front of the helmet. This has the aesthetic advantage that if the coupling means is designed in such a way as to be integrated into the overall shape of the helmet, which may be less possible with the locking means, the coupling means is sited in the generally more visible front area of the helmet and the locking means elsewhere.

With respect to the capability of relative pivotation of the crown and base body the crown is preferably pivotable through a predetermined angle to allow rotation of crown without obstruction by the base body. This predetermined angle can be a comparatively small angle, for example 10 to 15 degrees depending on the shape and dimensions of the base body and crown. Pivotation of the crown away from and towards the base body can thus be accomplished quickly by relatively short movements. It is advantageous if the helmet comprises abutment means to limit pivotation of the crown relative to the base body in a direction away from the body, in which case the abutment means can be provided in the region of the afore-mentioned pedestal when present. The abutment means serves to prevent excessive relative pivotation of the crown and base body such as might lead to over-stressing of the coupling means.

For preference, the locking means comprises a clip, particularly a quick-action clip of non-resilient construction. Such a clip serves to provide a rigid helmet construction precluding relative movement of the base body and crown, especially when the latter is in its protective position. A particularly suitable form of clip is an over-centre toggle latch, which is not only easy to operate, but also can be constructed to exert a clamping force urging the crown toward the base body and thereby enhancing the rigidity of the assembly represented by the locked-together base body and crown. In a particularly convenient arrangement, the clip is mounted on the base body and is releasably engageable with the crown, in which case the base body can be constructed for load-bearing mounting of the locking means and the crown construction can be focussed primarily on the requirement to protect the vulnerable top part of the head of a wearer. Although a clip, especially with a quick-action over-centre toggle mechanism, represents a particularly advantageous construction of the locking means, other forms of locking means are equally possible.

For preference, the coupling means and locking means are respectively arranged at two mutually opposite sides of the base body and crown. This provides a symmetrical connection of the two main helmet parts by way of the coupling means on the one hand and the locking means on the other hand and prevents any possibility of the crown lifting, even if only partially, from the base body. If the coupling means is located at an intended front of the helmet, the locking means—which may be of more mechanical appearance—can be positioned at an intended back of the helmet where it will normally be less noticeable when the helmet is worn.

In a preferred embodiment the base body has an internal step and the crown has a rim portion which is receivable in the base body to rest on the step for support of the crown in the protective position. The crown can thus be supported relative to the base body with use of a geometry that interlocks when the crown is in the protective position on the base body. With the locking means in its locking state, the crown is captively retained at the base body and the two parts are immovable relative to one another.

The base body and the crown are preferably plastics material mouldings, especially injection-moulded parts of a suitable hard plastics material. For preference, the base body and crown are made of the same material, but different materials can be selected if this should be advantageous in a particular case. A desirable combination of light weight, material saving and overall strength, particularly with respect to impact resistance, can be achieved if at least one of the base body and the crown has in part a lattice structure. Little or no loss of overall impact resistance results from use of a lattice structure rather than a solid casing; on the contrary, the achieved weight saving allows use of generously dimensioned lattice-defining webs, especially deeper webs between the notional inner and outer boundary or shell surfaces of the base body and crown, to enhance impact resistance. With advantage, the lattice structure is a honeycomb structure, which is well-recognised as a lightweight geometric form offering a high load-bearing capability. This recognition will contribute to a user perception of helmet strength. The honeycomb structure of the base body and/or crown can be designed in such a way as to be compatible with production by injection moulding techniques. This allows the helmet to be manufactured in two principal parts using homogenous materials suitable for recycling.

In a preferred embodiment the helmet comprises a helmet retaining strap for retaining the base body and crown on the head of a wearer, in which case the base body and crown in the stored position of the latter can define a space able to accommodate the strap. In the collapsed state the helmet can thus form a compact and self-contained unit.

A preferred embodiment of the present invention will now be more particularly described with reference to the accompanying drawings, in which.

Figure 1:
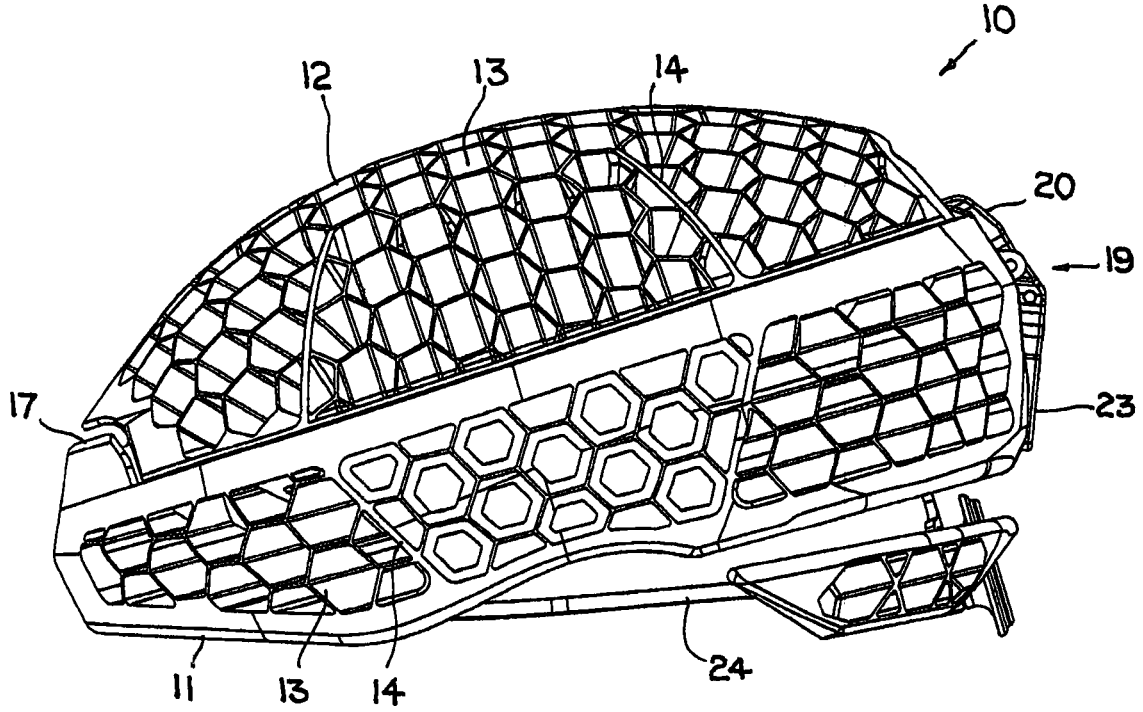
FIG. 1 is a side view of a helmet embodying the invention, in a wearable configuration with a crown of the helmet in a protective position on a base body of the helmet.
Figure 4:
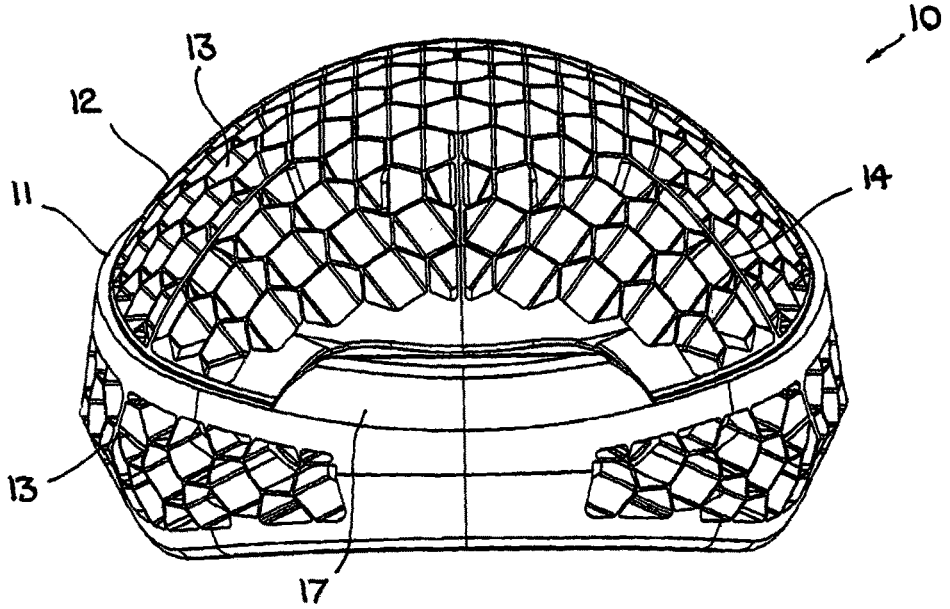
FIG. 4 is a front view of the helmet of FIG. 1.
Figure 5:
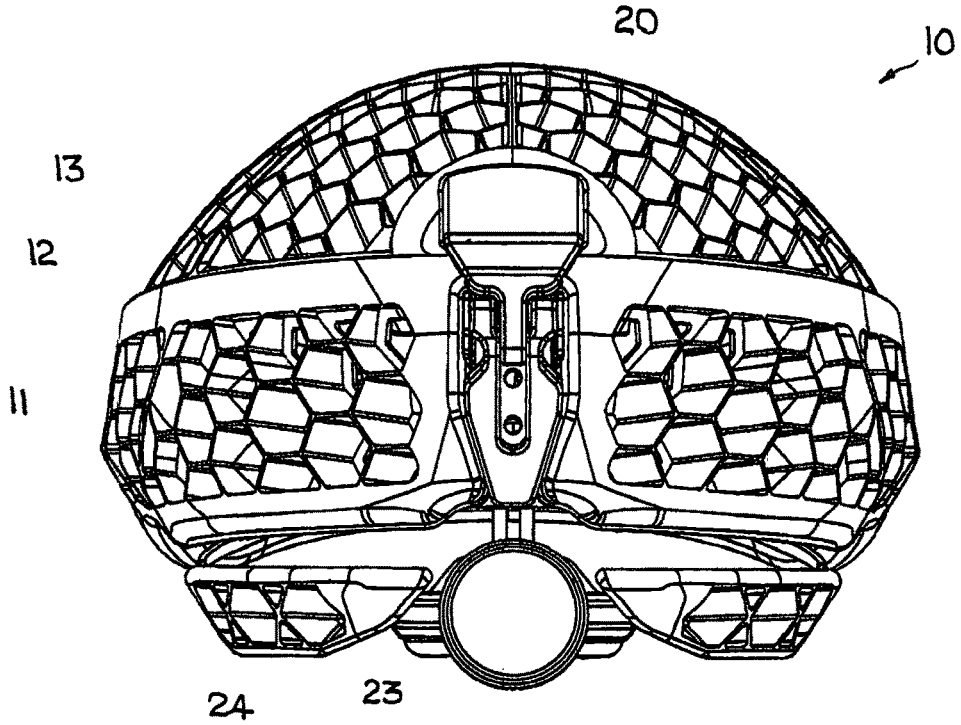
FIG. 5 is a back view of the helmet of FIG. 1.

Referring now to the accompanying drawings there is shown a multi-part collapsible helmet 10 comprising a substantially oval (in plan) impact-resistant base body 11 of such a size and shape that it can encircle the head of a wearer when the helmet is worn and an impact-resistant crown 12 which, when the helmet is worn, complements the base body as shown in FIGS. 1, 4 and 5 to create an approximately part-ellipsoidal shape generally corresponding with the cranium. The base body 11 is, as shown in those and other figures, gently contoured to reflect or accommodate cranial curvature, the ear regions and the junction of the head with the neck. In practice, the helmet may be produced in a small range of sizes appropriate to the different head sizes of wearers, for example children and adults, and in its marketed form will have an internal cushioning lining (not shown) typical of helmets and related protective headwear.

Each of the base body 11 and crown 12 is an integral injection-moulded component of hard polymer material, but derives increased impact resistance together with light weight primarily from a partly internally skinned honeycomb structure 13 with additional integrated, spaced-apart stiffening ribs 14 oriented somewhat similarly to lines of longitude with respect to a quasi-equatorial plane at the interface of base body and crown. The specifics of component shaping and the detail lattice structure are amenable to variation and the illustrated forms are merely examples which combine functionality and aesthetics, in the latter respect especially an impression of strength.

The crown 12 is coupled to the base body 11 by coupling means permitting movement of crown relative to the base body between a protective position (FIGS. 1 to 5) in which the crown is supported by the base body in an orientation in which the crown covers the top of the head of the wearer when the helmet 10 is worn and a stored position (FIGS. 9 to 11) which is inverted relative to the protective position and in which the crown is supported by, but nested in, the base body when the helmet is not worn. Support of the crown 12 by the base body 11 in the protective position of the former is provided by engagement of a rim portion of the crown in the base body to rest on an internal encircling step of the base body. This ensures that any impact on the top of the crown is accepted by the base body without any tendency to force the crown further into the base body. In the stored position of the crown, a step of the rim portion can rest on the upper edge face of the base body, i.e. the face adjoined by the crown when in the protective position, or the external surface of the honeycomb structure of the crown can simply rest on the internal surface of the honeycomb structure, thus the skinning of that structure, of the base body.

Figure 6:
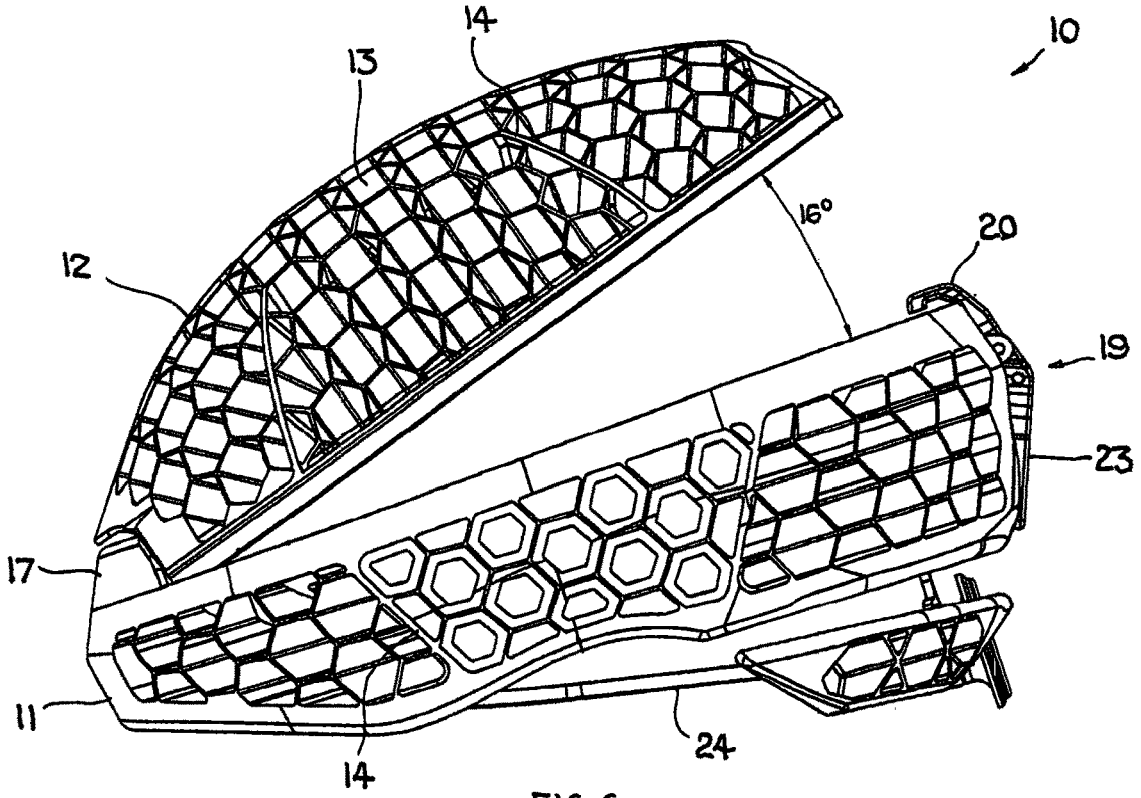
FIG. 6 is a side view of the helmet of FIG. 1, but with the crown pivoted up from the base body.
Figure 7:
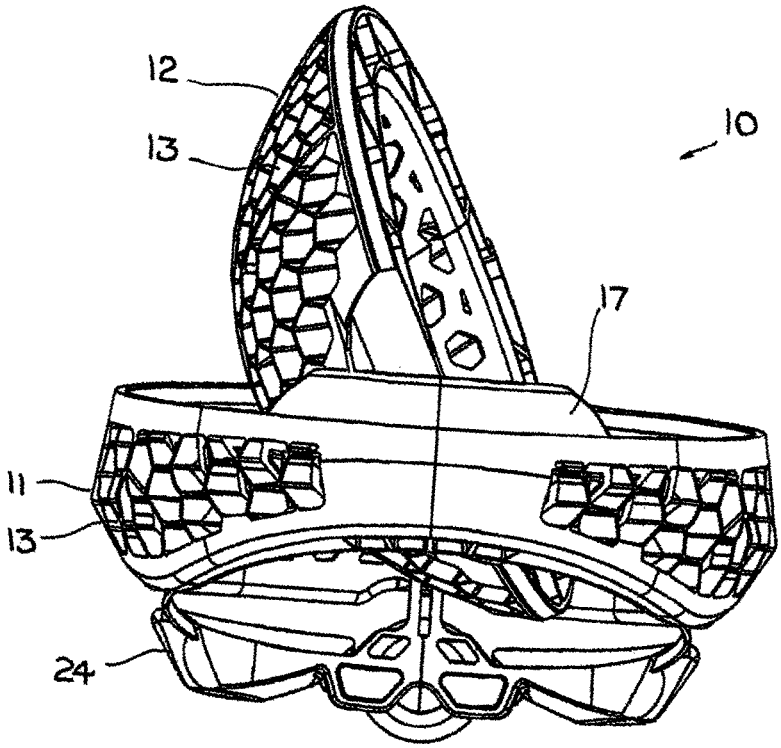
FIG. 7 is a front view of the helmet, but tilted in relation to FIG. 4 and with the pivoted-up crown part rotated through part of an intended half revolution.

The coupling means comprises a ball-and-socket universal joint 15, which consists of a socket 16 integrally formed in a pedestal 17 moulded on the base body 11 at an intended front of helmet 10 and a hollow ball 18 integrally mounted on the crown 12. The pedestal 17 is received in a recess in the crown when the crown is in the protective position and in that configuration of the helmet the pedestal shape effectively complements the crown to maintain the curved external contour of the latter. The ball 18 is a press fit in the socket 16 and for that purpose is slotted to allow sufficient compression, under resilient yielding of the ball material, in order to pass through the entrance of the socket and locate therein under relaxation of the material and return expansion of the ball, whereby the ball is mounted in the socket to be rotatable within the constraints imposed by adjacent features of the helmet. In that respect and starting with the crown 12 in the protective position as shown in FIGS. 1, 4 and 5, the joint 15 allows pivotation of the crown 12 about a first axis in a direction away from the base body 11 through a maximum angle of, for example, 16 degrees as shown in FIG. 5, then rotation of the crown relative to the base body about a second axis, which is perpendicular to the first axis, through 180 degrees as shown in FIGS. 6 and 7 so as to invert the crown, and finally pivotation of the crown again about the first axis, but now in a direction back towards the base body until the crown enters the interior space of the base body and assumes the stored position. Rotation of the crown about the second axis can be carried out when the crown has been pivoted away from the base body by about 10 to 15 degrees, specifically when the crown in its pivoted-away state has clearance for rotation about the second axis without obstruction by or otherwise collision with the base body. The point at which clearance is available depends on shape parameters of the crown such as its height and width as considered in the sense of wearing of the helmet, i.e. vertically and laterally across the head of a wearer.

The maximum angle of pivotation is determined by suitable pivot range limitation, in this embodiment by interengagement of the crown 12 and the base body 11 in the vicinity of the pedestal 17, for example contact of a neck of the ball 18 with a boundary of the entrance to the socket 16. The neck and the boundary thus represent abutment means. Other forms of abutment means to limit pivotation are, however, conceivable.

Figure 2:
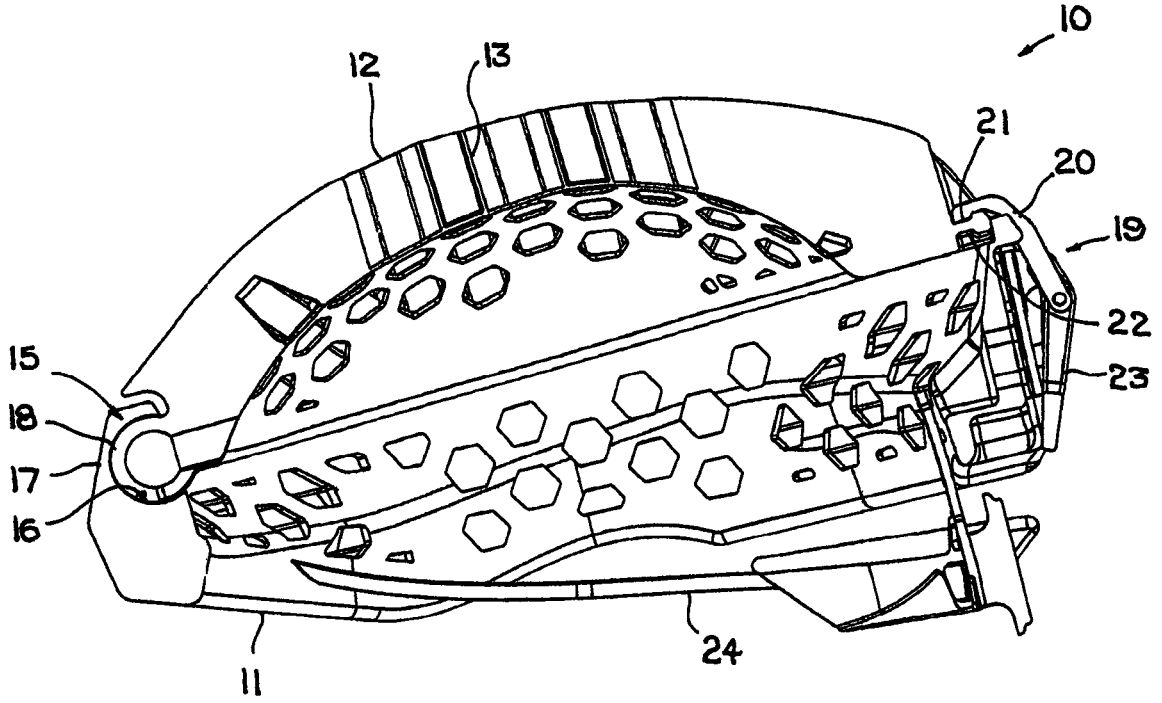
FIG. 2 is a cross-sectional view similar in orientation to the view of FIG. 1, but in a medial plane of the helmet to show details of a coupling of the crown and base body.
Figure 3:
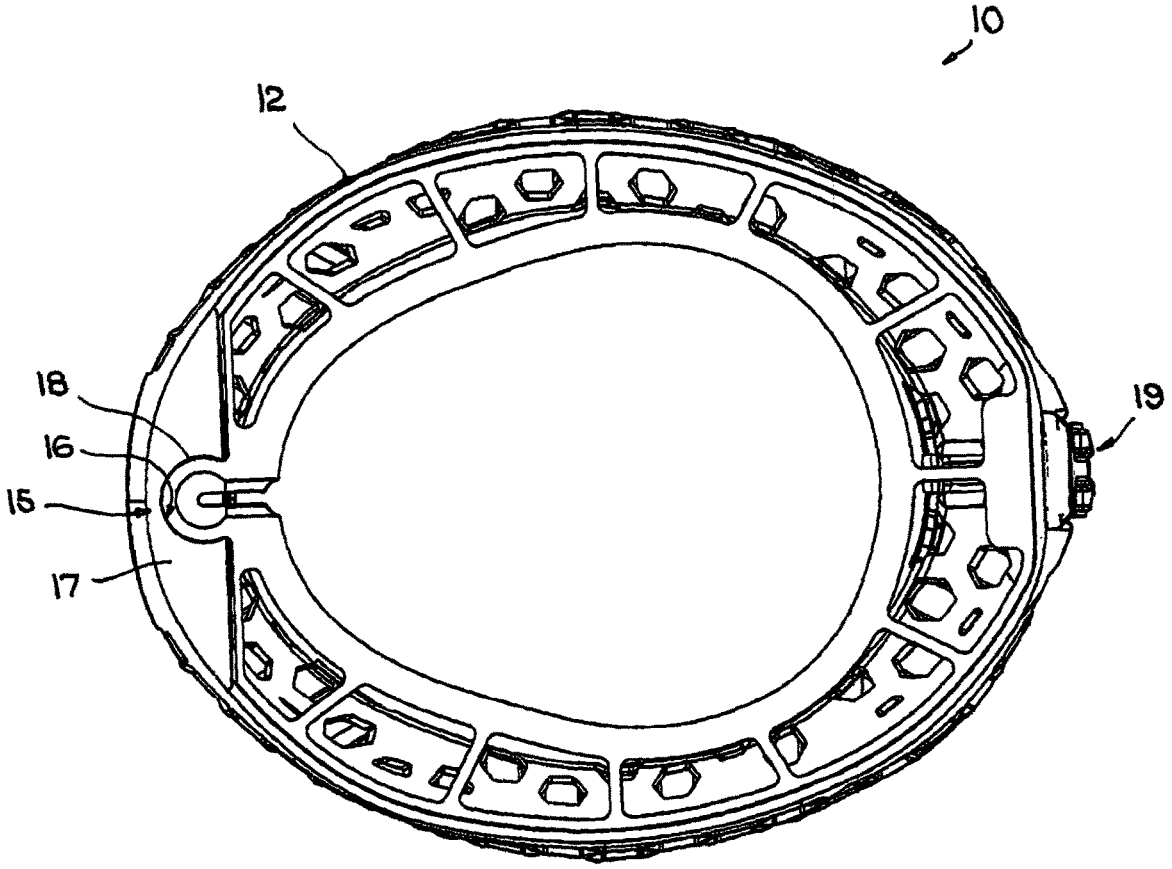
FIG. 3 is a cross-sectional view in a plane through the coupling and perpendicular to that of FIG. 2.
Figure 10:
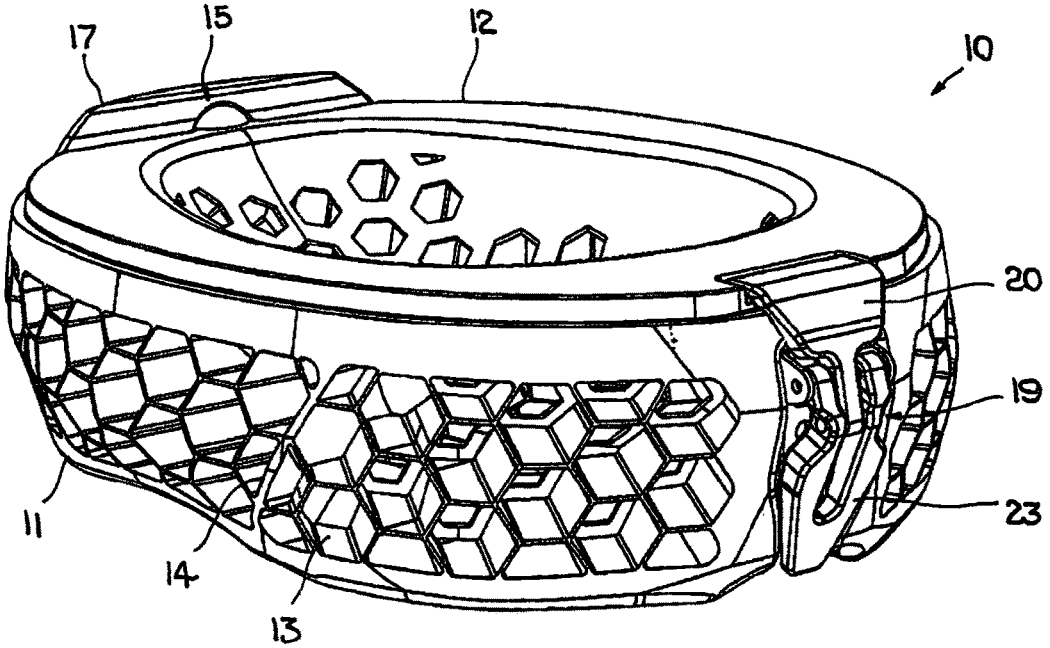
FIG. 10 is a perspective view from above and the back of the helmet in the collapsed configuration of FIG. 9.

In order to fix the crown 12 to the base body 11 in the protective position and also stored position of the former so as to create a rigid unit the helmet is provided at the back with a locking clip in the form of an over-centre toggle-action clamping latch 19, which is mounted on the base body and bears by a hook 20 against a respective clamping surface 21 or 22 of the crown in each of the two crown positions, each clamping surface being provided in an individual recess in the crown and including a detent projection for detenting interaction with the hook 20 as can be seen in the sectional view of FIG. 2. FIG. 2 shows the hook bearing against the clamping surface 21 associated with the protective position and, below that clamping surface, the free clamping surface 22 associated with the stored position, while FIG. 10 shows the hook 20 in its position bearing against the clamping surface 22 (not visible) associated with the stored position. The two clamping surfaces 21 and 22 are formed by opposite sides of an approximately T-section bar separating the two recesses. FIG. 10 also shows the detail construction of the clamping latch 19, from which it is evident that the hook 20 is pivotably connected with a manual operating lever 23 pivotably attached to the base body 11 by way of two projecting lugs integrally formed with or otherwise secured to the base body. Starting from the configuration in which the crown is in its protective position (FIG. 1), pivotation of the lever 23 away from the base body beyond an over-centre point relaxes the hook 20 to permit disengagement from the clamping surface 21, including the detent projection thereat. Subsequent pivotation towards the base body back beyond the over-centre point and then re-engagement of the hook with the clamping surface 21 or—if the crown has been rotated in the interim—engagement with the clamping surface 22 causes the hook to pressurably bear against the surface 21 or 22 and firmly clamp the crown 11 and base body 12 together. The latch 19, which consists of only two components plus two pivot pins, is operable simply and quickly for locking the crown and base body together to form a rigid unit in either the protective position or the stored position of the crown. In the locked state in either of these configurations, the interengagement of the hook and the detent projection at the clamping surface 21 or 22 prevents unintentional release of the latch, in particular release without operation of the lever 23. The lever is partly receivable in a depression in the base body 11 to reduce susceptibility to accidental operation.

Figure 11:
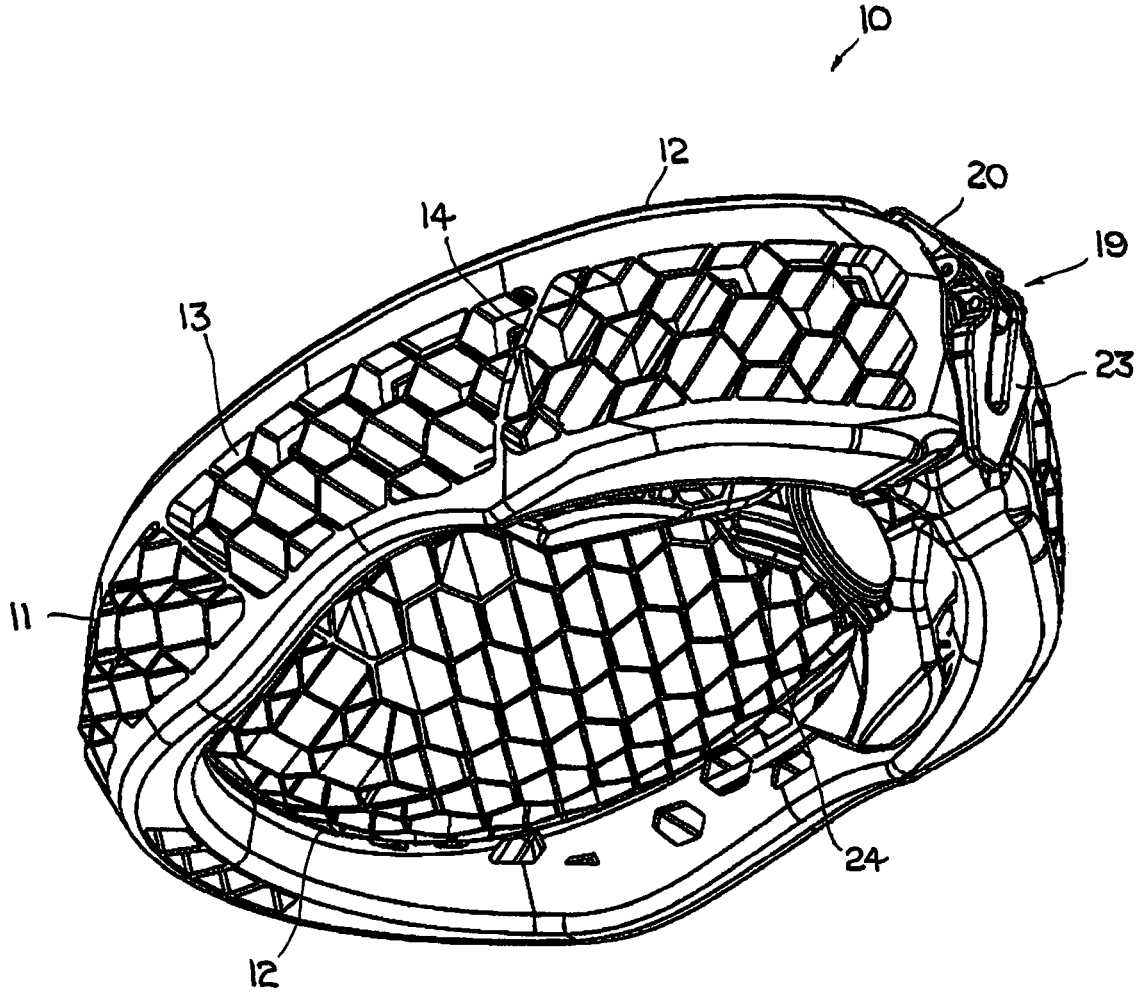
FIG. 11 is a perspective view from below and the back of the helmet in the collapsed configuration of FIG. 9, showing accommodation of a retaining strap of the helmet within the base body.

Finally, the base body 11 is fitted with a helmet retaining strap 24 which incorporates a cushioned neck brace carrying a reflector and tethered to the interior of the base body (cf. FIGS. 1, 2 and 5 to 8). In the collapsed state of the helmet, with the crown 12 stored inverted in the base body 11, the strap 24 inclusive of brace can be accommodated in an open-sided cavity bounded by an exterior surface of the inverted crown and an interior surface of the base body, as shown in FIG. 11.

Figure 8:
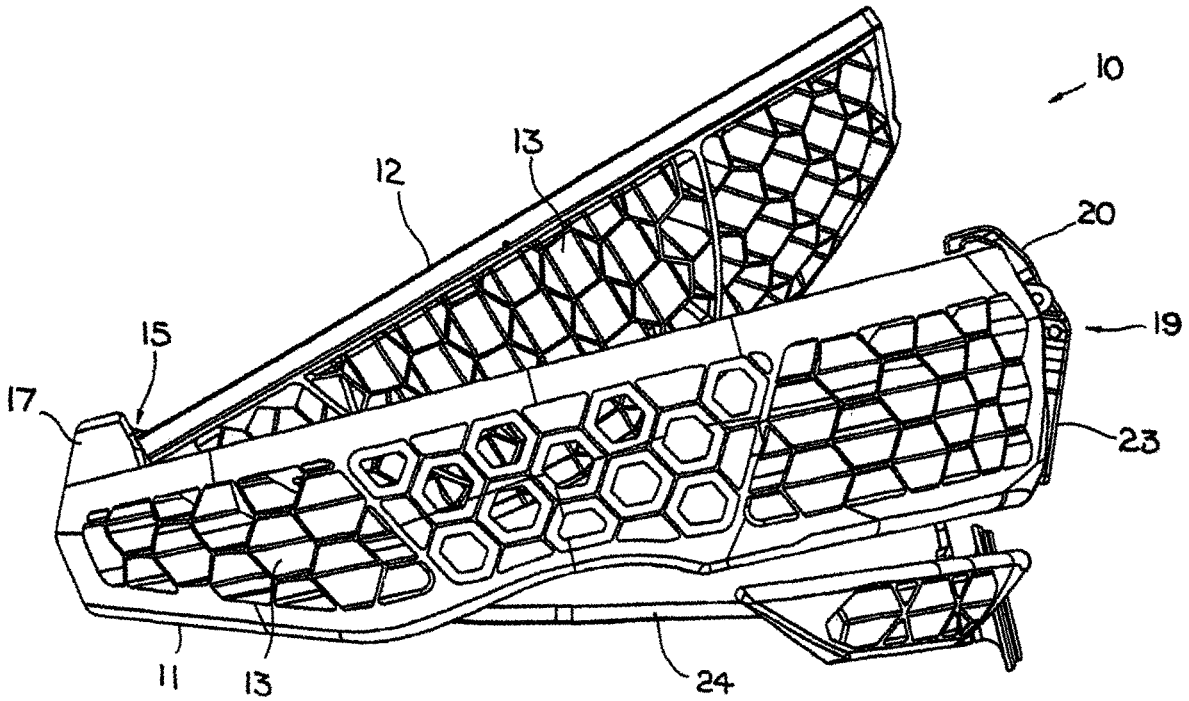
FIG. 8 is a side view similar to FIG. 6, but with the crown rotated through the entire half revolution and in readiness for pivotation towards the base body and a stored position therein.
Figure 9:
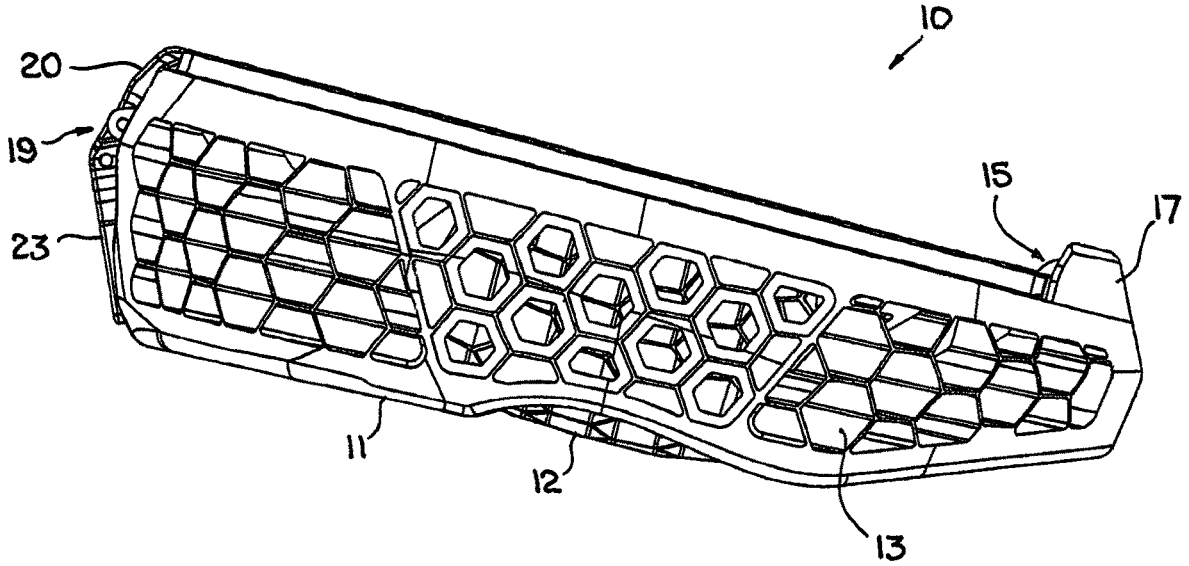
FIG. 9 is a side view similar to FIG. 1, but from the opposite side and in a collapsed configuration with the crown in a stored position in the base body.

Transition of the helmet 10 between its configurations, i.e. the wearable or use state with the crown 12 in the protective position on the base body 11 and the collapsed state with the crown 12 stored in the base body 11, is evident from the foregoing description in conjunction with the drawings. Thus, arbitrarily starting from the wearable state as shown in FIGS. 1, 4 and 5 the latch 19 can be operated by way of its lever 23 to relax the pressure applied through the hook 20 to allow disengagement of the latter from the clamping surface 21 of the crown 12 so that the crown is free to pivot about the first axis relative to the base body 12. With the hook 20 clear of the clamping surface 21, the crown 12 can now be pivoted about the first axis in a direction away from the base body 11, a maximum limit (16 degrees) of such pivotation being shown in FIG. 6. At or prior to reaching that limit the crown 12 can now be rotated about the second axis relative to the base body, in particular rotated through 180 degrees. FIG. 7 shows an intermediate rotational phase of about 100 degrees and FIG. 8 shows the final phase of achieved rotation through 180 degrees; there is no constraint on rotation beyond 180 degrees, but this is not required. From this relationship of the crown 12 and base body 11 the former can now be pivoted about the first axis back towards the latter so that the crown nests in the base body as shown in FIG. 9. This pivotation is exemplified by FIGS. 8 and 9, which show the start state and end state of the range of return pivotation. The lever 23 of the latch 19 can then be operated to re-apply the hook 20, which now acts on the clamping surface 22—which is inverted in relation to the clamping surface 21—of the crown 12 as evident from FIGS. 10 and 11. In both the protective position and the stored position of the crown, the latch 19 when applied acts co-operatively with the oppositely disposed joint 15 to ensure the crown is urged against the base body to form a rigid unit precluding relative movement of the crown and base body. As a final aspect of the transition of the helmet from the wearable to the collapsed state the strap 24 is stowed in a cavity within the base body as mentioned further above and shown in FIG. 11.

A helmet embodying the present invention combines the virtues of light weight and, through its construction, a high level of impact resistance in the wearable state and is transferrable quickly and simply to a collapsed state convenient for carrying and stowage. The helmet consists of only two principal components, which can be economically produced from, for example, injection-moulded plastics material parts. Consequently, the helmet has a lower parts count and is generally of less complicated, but more robust, construction by comparison with at least some of the prior designs of collapsible or foldable helmets, while achieving a generally comparable or even better volume reduction in the collapsed or folded state.

What is claimed is:

1. A collapsible protective helmet comprising:

an impact-resistant base body configured to encircle the head of a wearer, an impact-resistant crown defining a rim portion, coupling means coupling the crown to the base body, wherein the crown is configured to be movable relative to the base body between a protective position in which the crown is supported by said rim portion on the base body in an orientation in which the crown is configured to cover the top of the head of the wearer when the helmet is worn, and a stored position, wherein the crown is inverted relative to the protective position and in which the crown is supported by and nested in the base body, and a releasable locking means for locking the base body and the crown together in each of the protective position and the stored position of the crown, the coupling means being configured to permit movement of the crown so that without detachment of the crown from the base body the crown is movable between the protective position and the stored position by pivotation of the crown relative to the base body in a direction away from the base body about a first axis of the coupling means, so as to no longer be supported by the base body in the protective position, and rotation of the crown relative to the base body about a second axis of the coupling means, through 180 degrees, and pivotation of the crown relative to the base body in a direction back towards the base body about said second axis so that the crown is inverted relative to said orientation in the protective position and supported at its rim portion on the base body in the stored position.

2. The helmet as claimed in claim 1, wherein the coupling means comprises a universal joint.

3. The helmet according to claim 2, wherein the universal joint comprises a ball rotatably mounted in a socket.

4. The helmet according to claim 3, wherein the ball is provided at the crown and the socket at the base body.

5. The helmet according to claim 4, wherein the socket is formed in a pedestal of the base body and the crown has a recess receiving the pedestal when the crown is in the protective position.

6. The helmet according to claim 4, wherein the ball is formed integrally with the crown.

7. The helmet according to claim 3, wherein the ball is made of yielding material and is slotted to allow compression under a pressure causing the ball material to yield.

8. The helmet according to claim 1, wherein the helmet has an intended front and back orientation with respect to wearing by a wearer and the coupling means is provided at the front of the helmet.

9. The helmet according to claim 1, wherein the crown is pivotable relative to the base body through a predetermined angle to then allow rotation of crown without obstruction by the base body.

10. The helmet according to claim 1, comprising abutment means to limit pivotation of the crown relative to the base body in a direction away therefrom.

11. The helmet according to claim 1, wherein the locking means comprises a clip.

12. The helmet according to claim 11, wherein the clip is an over-centre toggle latch.

13. The helmet according to claim 11, wherein the clip is mounted on the base body and is releasably engageable with the crown.

14. The helmet according to claim 1, wherein the coupling means and locking means are respectively arranged at two mutually opposite sides of the base body and crown.

15. The helmet according to claim 1, wherein the base body has an internal step and the crown has a rim portion which is receivable in the base body to rest on the step for support of the crown in the protective position.

16. The helmet according to claim 1, wherein the base body and the crown are plastics material mouldings.

17. The helmet according to claim 1, wherein at least one of the base body and the crown has in part a lattice structure.

18. The helmet according to claim 17, wherein the lattice structure is a honeycomb structure.

19. The helmet according to claim 1, comprising a helmet retaining strap for retaining the base body and crown on the head of a wearer, wherein the base body and crown in the stored position of the crown define a space able to accommodate the strap.

* * * * *